US009069281B2

(12) United States Patent
Ohashi et al.

(10) Patent No.: US 9,069,281 B2
(45) Date of Patent: Jun. 30, 2015

(54) DEVELOPING DEVICE INCLUDING DEVELOPING ROLLER THAT FEEDS TONER TO IMAGE CARRYING MEMBER AND TONER FEEDING ROLLER THAT FEEDS TONER TO DEVELOPING ROLLER, AND IMAGE FORMING APPARATUS PROVIDED THEREWITH

(71) Applicant: KYOCERA DOCUMENT SOLUTIONS INC., Osaka (JP)

(72) Inventors: Hiroaki Ohashi, Osaka (JP); Ryoji Nishimura, Osaka (JP); Masahiro Kashimoto, Osaka (JP); Takeshi Fujimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/924,097

(22) Filed: Jun. 21, 2013

(65) Prior Publication Data

US 2013/0343787 A1 Dec. 26, 2013

(30) Foreign Application Priority Data

Jun. 26, 2012 (JP) ..... 2012-142700

(51) Int. Cl.
*G03G 15/08* (2006.01)

(52) U.S. Cl.
CPC ..... *G03G 15/0812* (2013.01); *G03G 15/0808* (2013.01)

(58) Field of Classification Search
CPC ..... G03G 15/0812; G03G 15/0808
USPC ..... 399/274, 275
See application file for complete search history.

(56) References Cited

U.S. PATENT DOCUMENTS 6,035,169 A * 3/2000 Miyake et al.
2013/0084108 A1* 4/2013 Suzuki et al. ..... 399/274

FOREIGN PATENT DOCUMENTS

| | | | |
|---|---|---|---|
| JP | H10-123832 | A | 5/1998 |
| JP | 2006-195163 | A | 7/2006 |
| JP | 2006-317889 | A | 11/2006 |
| JP | 2010-276954 | A | 12/2010 |
| JP | 2011-013248 | A | 1/2011 |

OTHER PUBLICATIONS

English Abstract and Translation for JP 2010-276954 A, published Dec. 9, 2010.
English language Abstract and Machine Translation for JP 2011-013248 A, published Jan. 20, 2011.

(Continued)

*Primary Examiner* — David Gray
*Assistant Examiner* — Laura Roth
(74) *Attorney, Agent, or Firm* — NDQ&M Watchstone LLP

(57) ABSTRACT

A developing device of the present disclosure includes a developing roller, a toner feeding roller, a thickness regulating member, and a casing. The toner feeding roller feeds toner to the developing roller. The thickness regulating member is disposed opposite to the toner feeding roller at a predetermined distance from the toner feeding roller, and the thickness regulating member regulates a thickness of the toner carried on the toner feeding roller. The casing holds therein the developing roller, the toner feeding roller, and the thickness regulating member. The thickness regulating member is formed in a roller shape and rotatable.

5 Claims, 5 Drawing Sheets

(56) References Cited

OTHER PUBLICATIONS

English language Abstract and Machine Translation for JP 2006-317889 A, published Nov. 24, 2006.

English language Abstract and Machine Translation for JP H10-123832 A, published May 15, 1998.

English language Abstract and Machine Translation for JP 2006-195163 A, published Jul. 27, 2006.

* cited by examiner

DEVELOPING DEVICE INCLUDING DEVELOPING ROLLER THAT FEEDS TONER TO IMAGE CARRYING MEMBER AND TONER FEEDING ROLLER THAT FEEDS TONER TO DEVELOPING ROLLER, AND IMAGE FORMING APPARATUS PROVIDED THEREWITH

INCORPORATION BY REFERENCE

This application is based on Japanese Patent Application No. 2012-142700 filed on Jun. 26, 2012.

BACKGROUND

The present disclosure relates to a developing device and an image forming apparatus provided therewith, and in particular, to a developing device including a developing roller that feeds toner to an image carrying member and a toner feeding roller that feeds toner to the developing roller, and an image forming apparatus provided therewith.

In an electrophotographic image forming apparatus, an electrostatic latent image is formed on a peripheral surface of an image carrying member (a photosensitive drum) by irradiating the surface with light based on image information read from an original image or based on image information transmitted from an external device such as a computer, and the electrostatic latent image is developed into a toner image with toner fed from a developing device, and then, the toner image is transferred onto a sheet. The sheet that has undergone the transfer process then undergoes a fixing process, where the toner image is fixed thereon, and then the sheet is ejected to outside the apparatus.

Now, image forming apparatuses have recently come to have complicated structures to achieve high performance such as color printing and increasingly high-speed processing, and the high-speed processing requires high-speed rotation of a toner stirring member inside the developing device. Specifically, with a developing method where a two-component developer including a magnetic carrier and toner is used with a magnetic roller (a toner feeding roller) to carry the developer and a developing roller to carry only the toner, in an opposing portion where the developing roller and the magnetic roller face each other, only the toner is carried on the developing roller via a magnetic brush formed on the magnetic roller, and further, such part of the toner as has been left without being used for development is ripped off from the developing roller. This causes the toner to be prone to float around the opposing portion where the developing roller and the magnetic roller face each other, and such toner accumulates in the vicinity of an ear cutting blade (a thickness regulating member), and if the accumulated toner aggregates and adheres to the developing roller, it may lead to dropping of the toner and result in a defective image.

As a countermeasure, for example, there has been known the following developing device that uses a two-component developer including a magnetic carrier and toner, the developing device having a magnetic roller to carry the developer and a developing roller to carry only the toner. That is, an air inlet hole for taking-in air from outside the developing device is formed through a wall of a developing container, the wall facing the developing roller and the magnetic roller, to thereby generate an air flow to make toner floating around an ear cutting blade move upward.

Even in the case, however, where such an air inlet hole is provided to take in air from outside the developing device, if the apparatus itself operates at a high speed and a large amount of toner floats, it is difficult to fully put the floating toner into the air flow generated by the rotation of the magnetic and developing rollers. This may allow the toner to accumulate and aggregate around the ear cutting blade.

The present disclosure has been made to solve the problems described above, and an object of the present disclosure is to provide a developing device capable of effectively reducing accumulation and aggregation of toner around a thickness regulating member, and an image forming apparatus provided therewith.

SUMMARY

According to an aspect of the present disclosure, a developing device includes a developing roller, a toner feeding roller, a thickness regulating member, and a casing. The developing roller is disposed opposite to an image carrying member on which an electrostatic latent image is formed, and the developing roller feeds toner to the image carrying member in an opposing region where the developing roller and the image carrying member face each other. The toner feeding roller is disposed opposite to the developing roller, and the toner feeding roller feeds toner to the developing roller in an opposing region where the toner feeding roller and the developing roller face each other. The thickness regulating member is disposed opposite to the toner feeding roller at a predetermined distance from the toner feeding roller, and the thickness regulating member regulates a thickness of toner carried on the toner feeding roller. The casing holds therein the developing roller, the toner feeding roller, and the thickness regulating member. The thickness regulating member is disposed below the opposing region where the developing roller and the toner feeding roller face each other, the thickness regulating member is formed in a roller shape, and the thickness regulating member is rotatable in a same direction as a direction in which the toner feeding roller rotates during a developing operation.

Other objects and specific advantages of the present disclosure will become more apparent from the descriptions of embodiments set forth below.

DETAILED DESCRIPTION

Embodiments of the present disclosure will be described below with reference to the accompanying drawings.

Figure 1:
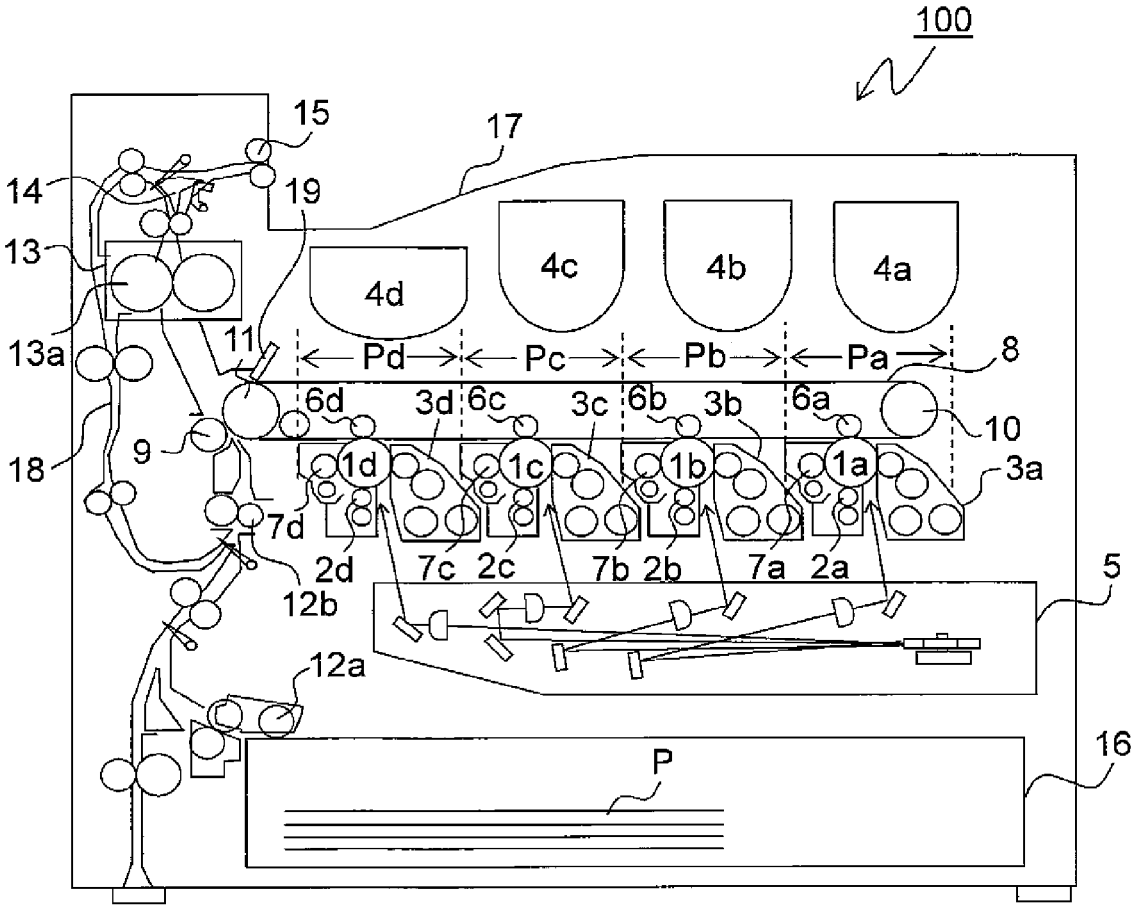
FIG. 1 is a sectional view schematically showing a structure of an image forming apparatus according to an embodiment of the present disclosure.
Figure 2A:
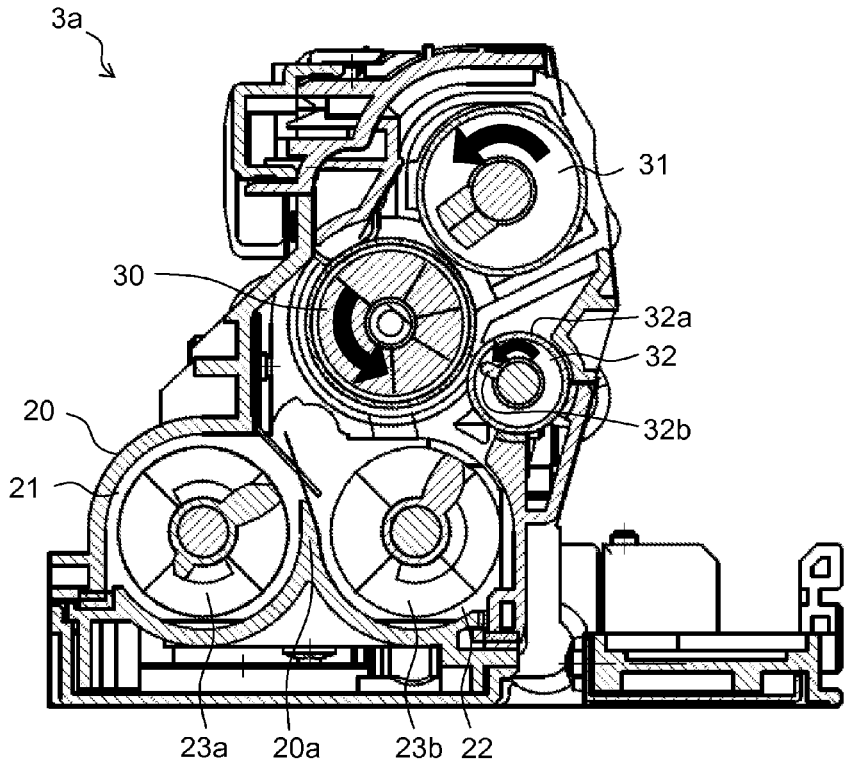
FIG. 2 is a side sectional view showing a structure of a developing device according to the embodiment of the present disclosure.
Figure 2B:
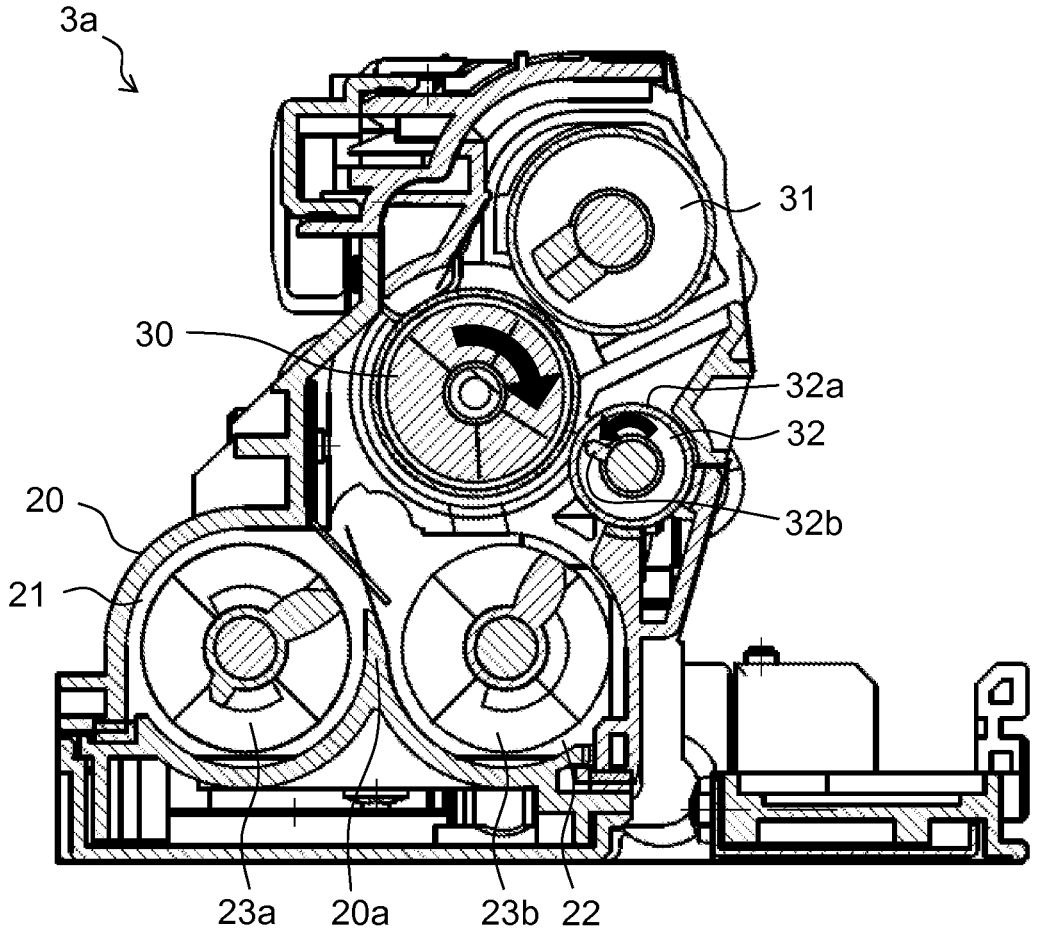
Figure 3:
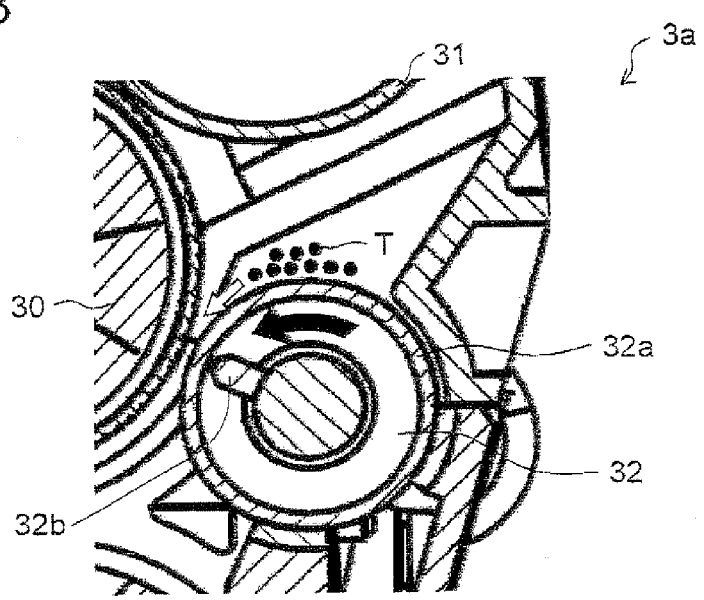
FIG. 3 is a side sectional view showing a structure around a thickness regulating member in the developing device according to the embodiment of the present disclosure.

With reference to FIGS. 1 to 3, a description will be given of a structure of an image forming apparatus 100 according to an embodiment of the present disclosure. Inside a main body of the image forming apparatus 100 (here, a color printer), four image forming portions Pa, Pb, Pc, and Pd are arranged in this order from an upstream side in a transporting direction (on the right in FIG. 1). These image forming portions Pa to Pd are disposed to form images of four different colors (cyan, magenta, yellow, and black), and the image forming portions Pa, Pb, Pc, and Pd sequentially fowl a cyan image, a magenta image, a yellow image, and a black image, respectively, through charging, exposure, developing, and transfer processes.

In the image forming portions Pa, Pb, Pc, and Pd, photosensitive drums (image carrying members) 1*a*, 1*b*, 1*c*, and 1*d* are disposed, respectively, to each carry a visible image (a toner image) of a corresponding color. Furthermore, an intermediate transfer belt 8 that rotates clockwise in FIG. 1 by being driven by driving means (not shown) is provided adjacent to the image forming portions Pa to Pd. Toner images respectively formed on the photosensitive drums 1*a* to 1*d* are sequentially primarily transferred onto the intermediate transfer belt 8 moving in contact with the photosensitive drums 1*a* to 1*d* such that the toner images are superimposed one on another on the intermediate transfer belt 8. Then, the toner images that have been primarily transferred onto the intermediate transfer belt 8 are secondarily transferred onto a transfer sheet P as an example of a recording medium by action of a secondary transfer roller 9. Moreover, the toner images that have been secondarily transferred onto the transfer sheet P are fixed at a fixing portion 13, and then the transfer sheet P is ejected out of the main body of the image forming apparatus 100. While the photosensitive drums 1*a* to 1*d* are being rotated counterclockwise in FIG. 1, an image forming process is performed with respect to each of the photosensitive drums 1*a* to 1*d*.

The transfer sheet P onto which the toner images are to be secondarily transferred is put in a sheet cassette 16 arranged in a lower portion of the main body of the image forming apparatus 100, and is transported via a sheet feeding roller 12*a* and a registration roller pair 12*b* to a nip portion formed between the secondary transfer roller 9 and a later-described drive roller 11 for driving the intermediate transfer belt 8. The intermediate transfer belt 8 is made of a dielectric resin sheet, and the intermediate transfer belt 8 is typically formed as a (seamless) belt having no seam. Further, on a downstream side of the secondary transfer roller 9, a blade-shaped belt cleaner 19 is arranged for removing the toner and the like remaining on a surface of the intermediate transfer belt 8.

Next, the image forming portions Pa to Pd will be described. Around and below the rotatably disposed photosensitive drums 1*a* to *d*, there are provided: chargers 2*a*, 2*b*, 2*c*, and 2*d* for charging the photosensitive drums 1*a*, 1*b*, 1*c*, and 1*d*, respectively; an exposure device 5 for performing exposure with respect to the photosensitive drums 1*a* to 1*d* based on image information; developing devices 3*a*, 3*b*, 3*c*, and 3*d* for forming toner images on the photosensitive drums 1*a*, 1*b*, 1*c*, and 1*d*, respectively; and cleaning portions 7*a*, 7*b*, 7*c*, and 7*d* for removing developers (toner) and the like remaining on the photosensitive drums 1*a*, 1*b*, 1*c*, and 1*d*, respectively.

When image data is fed from a higher-level device such as a personal computer, the chargers 2*a* to 2*d* first charge surfaces of the photosensitive drums 1*a* to 1*d* uniformly, and then the exposure device 5 applies light according to the image data to form electrostatic latent images corresponding to the image data on the photosensitive drums 1*a* to 1*d*. The developing devices 3*a* to 3*d* are respectively filled with predetermined amounts of two-component developers respectively including cyan toner, magenta toner, yellow toner, and black toner. Note that, the developing devices 3*a*, 3*b*, 3*c*, and 3*d* are supplied with toner from toner containers (supply portions) 4*a*, 4*b*, 4*c*, and 4*d*, respectively, when a proportion of toner in each of the two-component developers present in the respective developing devices 3*a* to 3*d* is reduced to below a preset value as a result of later-described formation of toner images. The toner within the developers is supplied onto the photosensitive drums 1*a* to 1*d* by the developing devices 3*a* to 3*d*. Then, the toner electrostatically adheres to the respective photosensitive drums 1*a* to 1*d*, and thereby the toner images, which correspond to the electrostatic latent images formed by the exposure performed by the exposure device 5, are formed on the photosensitive drums 1*a* to 1*d*.

Then, by primary transfer rollers 6*a*, 6*b*, 6*c*, and 6*d*, an electric field is applied at a predetermined transfer voltage between the primary transfer rollers 6*a*, 6*b*, 6*c*, and 6*d* and the photosensitive drums 1*a*, 1*b*, 1*c*, and 1*d*, respectively, and the toner images of cyan, magenta, yellow, and black on the photosensitive drums 1*a* to 1*d* are primarily transferred onto the intermediate transfer belt 8. The toner images of the four colors are formed to have a predetermined positional relationship that is previously set for forming a predetermined full-color image. After that, in preparation for formation of new electrostatic latent images to be subsequently performed, the toner and the like remaining on the surfaces of the photosensitive drums 1*a*, 1*b*, 1*c*, and 1*d* after the primarily transfer are removed by the cleaning portions 7*a*, 7*b*, 7*c*, and 7*d*, respectively.

The intermediate transfer belt 8 is wound around a driven roller 10 on an upstream side and the drive roller 11 on a downstream side. When the intermediate transfer belt 8 starts to rotate clockwise in accordance with the rotation of the drive roller 11 caused by a drive motor (not shown), the transfer sheet P is transported from the registration roller pair 12*b* at a predetermined timing to a nip portion (a secondary transfer nip portion) between the drive roller 11 and the secondary transfer roller 9 provided adjacent to the drive roller 11, and a full-color toner image on the intermediate transfer belt 8 is secondarily transferred onto the transfer sheet P. The transfer sheet P onto which the toner image has been secondarily transferred is transported to the fixing portion 13.

At the fixing portion 13, heat and pressure are applied to the transported transfer sheet P by a fixing roller pair 13*a*, and the toner images are fixed onto a surface of the transfer sheet P to form the predetermined full-color image. The transfer sheet P on which the full-color image has been formed is directed toward one of a plurality of transporting directions branched from a branch portion 14. In a case where an image is formed on only one side of the transfer sheet P, the transfer sheet P is ejected as it is to an ejection tray 17 by an ejection roller pair 15.

On the other hand, in a case where images are formed on both sides of the transfer sheet P, the transfer sheet P that has passed through the fixing portion 13 is transported to a position where part of the transfer sheet P temporarily projects from the ejection roller pair 15 to outside the apparatus. Then, after a rear end of the transfer sheet P passes through the branch portion 14, the ejection roller pair 15 is rotated reversely, and a transporting direction at the branch portion 14 is switched. Thereby, the transfer sheet P is directed toward a sheet transport path 18 with its rear end at the head, and the transfer sheet P is transported again to the secondary transfer nip portion with its surface on which the image is formed reversed. Then, a next toner image formed on the intermediate transfer belt 8 is secondarily transferred by the secondary transfer roller 9 onto a surface of the transfer sheet P on which no image is formed. Then, the transfer sheet P onto which the toner image has been secondarily transferred is transported to the fixing portion 13, where the toner image is fixed onto the transfer sheet P, and then the transfer sheet P is ejected to the ejection tray 17.

Next, with reference to FIG. 2, a detailed description will be given of a structure of the developing device 3*a*. Note that FIG. 2 illustrates the developing device 3*a* of FIG. 1 as viewed from a rear surface side of FIG. 1, and arrangement of the components in the developing device 3*a* is left-right reversal to that of FIG. 1. Further, in the following description, only the developing device 3*a* disposed in the image forming portion Pa of FIG. 1 is exemplified, and the developing devices 3*b* to 3*d* disposed in the image forming portions Pb to Pd are not described. This is because the developing devices 3*b* to 3*d* have basically the same structure as the developing device 3*a*.

As shown in FIG. 2, the developing device 3*a* includes a developing container (a casing) 20 for storing the two-component developer (hereinafter, simply referred to as developer), and the developing container 20 is separated by a partition wall 20*a* into a stirring-and-transporting chamber 21 and a feeding-and-transporting chamber 22. In the stirring-and-transporting chamber 21 and the feeding-and-transporting chamber 22, a stirring-and-transporting screw 23*a* and a feeding-and-transporting screw 23*b*, respectively, are rotatably disposed for mixing and stirring toner (positively charged toner) to be supplied from a toner container 4*a* (see FIG. 1) with a carrier so that the toner is charged.

Then, the developer is transported in an axial direction (a direction perpendicular to the sheet surface on which FIG. 2 is drawn) while being stirred by the stirring-and-transporting screw 23*a* and the feeding-and-transporting screw 23*b*, and circulates between the stirring-and-transporting chamber 21 and the feeding-and-transporting chamber 22 through developer passages (not shown) formed at both end portions of the partition wall 20*a*. That is, a developer circulation path is formed of the stirring-and-transporting chamber 21, the feeding-and-transporting chamber 22, and the developer passages in the developing container 20.

The developing container 20 extends obliquely right upward in FIG. 2. Inside the developing container 20, a toner feeding roller 30 is disposed above the feeding-and-transporting screw 23*b*, and a developing roller 31 is disposed obliquely right above the toner feeding roller 30 to be opposite to the toner feeding roller 30. The developing roller 31 faces the photosensitive drum 1*a* (see FIG. 1) on an opening side of the developing container 20 (on the right side in FIG. 2). The toner feeding roller 30 and the developing roller 31 are rotated counterclockwise in FIG. 2 about respective rotation shafts thereof.

In the stirring-and-transporting chamber 21, an unillustrated toner concentration sensor is disposed to face the stirring-and-transporting screw 23*a*. Based on detection results of the toner concentration sensor, the stirring-and-transporting chamber 21 is supplied with toner from the toner container 4*a* through an unillustrated toner supply port. As the toner concentration sensor, for example, there is used a magnetic permeability sensor for detecting magnetic permeability of the two-component developer including the toner and a magnetic carrier in the developing container 20.

The toner feeding roller 30 is a magnetic roller formed of a non-magnetic rotary sleeve that rotates counterclockwise in FIG. 2, and a fixed magnet that is enclosed in the rotary sleeve and that has a plurality of magnetic poles.

The developing roller 31 is formed of a cylindrical developing sleeve that rotates counterclockwise in FIG. 2, and a developing roller side magnetic pole fixed in the developing sleeve. The toner feeding roller 30 and the developing roller 31 face each other at a facing position (an opposing position) with a predetermined gap therebetween. The developing roller side magnetic pole has a polarity that is opposite to a polarity of one of the magnetic poles of the fixed magnet (main pole), the one being to face the developing roller side magnetic pole.

Further, the developing container 20 is provided with a thickness regulating member 32 that regulates a thickness of the developer carried on the toner feeding roller 30. The thickness regulating member 32 is attached along a longitudinal direction of the toner feeding roller 30 (a direction perpendicular to the sheet surface on which FIG. 2 is drawn). In a rotation direction of the toner feeding roller 30 (a counterclockwise direction in FIG. 2), the thickness regulating member 32 is positioned on an upstream side of the opposing position where the developing roller 31 and the toner feeding roller 30 face each other. Further, the thickness regulating member 32 is arranged below an opposing portion (an opposing region) where the developing roller 31 and the toner feeding roller 30 face each other. A slight space (a gap) is formed between surfaces of the thickness regulating member 32 and the toner feeding roller 30.

To the developing roller 31, a direct-current voltage (hereinafter, referred to as Vslv (DC)) and an alternating-current voltage (hereinafter, referred to as Vslv (AC)) are applied. To the toner feeding roller 30, a direct-current voltage (hereinafter, referred to as Vmag (DC)) and an alternating-current voltage (hereinafter, referred to as Vmag (AC)) are applied. These DC voltages and AC voltages are applied to the developing roller 31 and the toner feeding roller 30 from a developing-bias power supply via a bias control circuit (neither is illustrated).

As described above, the developer circulates in the stirring-and-transporting chamber 21 and the feeding-and-transporting chamber 22 in the developing container 20 while being stirred by the stirring-and-transporting screw 23*a* and the feeding-and-transporting screw 23*b* to thereby charge the toner included in the developer. The developer in the feeding-and-transporting chamber 22 is transported to the toner feeding roller 30 by the feeding-and-transporting screw 23*b*. Then, a magnetic brush (not shown) is formed on the toner feeding roller 30. The magnetic brush on the toner feeding roller 30 is regulated in layer thickness by the thickness regulating member 32, and then transported by rotation of the toner feeding roller 30 to the opposing portion where the toner feeding roller 30 and the developing roller 31 face each other. In this way, a thin toner layer is formed on the developing roller 31 by means of a potential difference ΔV between Vmag (DC) applied to the toner feeding roller 30 and Vslv (DC) applied to the developing roller 31, and a magnetic field.

A thickness of the toner layer on the developing roller 31 varies depending on factors such as resistance of the developer and a difference in rotation speed between the toner feeding roller 30 and the developing roller 31, and the thickness is able to be controlled by means of ΔV. The toner layer on the developing roller 31 is thicker with a larger ΔV, thinner with a smaller ΔV. An appropriate range of ΔV at the time of development is typically approximately from 100 V to 350 V.

The thin toner layer formed on the developing roller 31 by means of contact with the magnetic brush on the toner feeding roller 30 is transported to an opposing portion (an opposing region) where the photosensitive drum 1*a* and the developing roller 31 face each other. To the developing roller 31, Vslv (DC) and Vslv (AC) are applied, and hence potential difference between the developing roller 31 and the photosensitive drum 1*a* causes the toner to fly from the developing roller 31 to the photosensitive drum 1*a*, to develop the electrostatic latent image on the photosensitive drum 1*a*.

Toner remaining without being used for development is transported again to the opposing portion where the developing roller 31 and the toner feeding roller 30 face each other, and is collected by the magnetic brush formed on the toner feeding roller 30. Then, the magnetic brush is ripped off from a portion of the toner feeding roller 30 having the same polarity as the fixed magnet, and then drops into the feeding-and-transporting chamber 22.

After that, based on detection results of the toner concentration sensor (not shown), a predetermined amount of toner is supplied through the toner supply port (not shown), to regenerate the two-component developer uniformly charged at an appropriate toner concentration while being circulated between the feeding-and-transporting chamber 22 and the stirring-and-transporting chamber 21. The developer is fed again onto the toner feeding roller 30 by the feeding-and-transporting screw 23*b* so as to form a magnetic brush, which is transported to the thickness regulating member 32.

The thickness regulating member 32 is formed in a roller-shape and rotatable. Specifically, the thickness regulating member 32 includes a hollow cylindrical portion 32*a* that rotates counterclockwise in FIG. 2 (in a direction that is the same as the direction in which the toner feeding roller 30 rotates during a developing operation), and a fixed magnetic member 32*b* that is disposed inside the cylindrical portion 32*a* so as to be opposite to the toner feeding roller 30. The magnetic member 32*b* is formed of, for example, a magnetic metal plate or a magnet.

As shown in FIG. 3, by means of intermittent or continuous rotation of the cylindrical portion 32*a*, toner T accumulated on the thickness regulating member 32 (the cylindrical portion 32*a*) passes between the thickness regulating member 32 and the toner feeding roller 30, to drop into the feeding-and-transporting chamber 22.

At this time, the cylindrical portion 32*a* rotates at a low speed (for example, at a speed lower than a speed at which the toner feeding roller 30 rotates during the developing operation). Further, as shown in FIG. 2B, the cylindrical portion 32*a* does not rotate during the developing operation, and rotates while the developing operation is not performed. In this case, it is preferable that the toner feeding roller 30 rotate in a direction opposite to a direction in which the cylindrical portion 32*a* rotates (that is, in a direction opposite to the direction in which the toner feeding roller 30 rotates during the developing operation, specifically, clockwise in FIG. 2A).

The thickness regulating member 32 may be rotated each time a printing operation is completed, or may be rotated each time printing is completed with respect to a predetermined number of sheets. Further, the rotation of the thickness regulating member 32 and the rotation of the toner feeding roller 30 in the opposite direction (clockwise in FIG. 2) may be performed at the same or different timing.

According to the present embodiment, as described above, the thickness regulating member 32 is formed in a roller-shape and rotatable. With this structure, it is possible, by rotating the thickness regulating member 32, to urge the toner floating to accumulate on the thickness regulating member 32 to drop off the thickness regulating member 32. This makes it possible to effectively reduce an amount of toner that accumulates and aggregates on the thickness regulating member 32. As a result, it is possible to effectively reduce adhesion of aggregated toner onto the developing roller 31, and thus to effectively reduce defective images.

Further, as described above, the thickness regulating member 32 includes the rotatable hollow cylindrical portion 32*a* and the magnetic member 32*b* disposed inside the cylindrical portion 32*a* so as to be opposite to the toner feeding roller 30. This makes it possible to easily regulate the thickness of toner carried on the toner feeding roller 30 while reducing aggregation of toner on the thickness regulating member 32.

Further, as described above, the thickness regulating member 32 rotates when the developing operation is not performed. This makes it possible to reduce difference between the thickness of toner carried on the toner feeding roller 30 and a set value of the thickness.

Further, as described above, when the thickness regulating member 32 rotates, the toner feeding roller 30 may be rotated in a direction opposite to the rotation direction of the thickness regulating member 32. In this ease, in the opposing region where the toner feeding roller 30 and the thickness regulating member 32 face each other, the surface of the toner feeding roller 30 and the surface of the thickness regulating member 32 that face each other move (rotate) in the same direction. As a result, the toner accumulated on the thickness regulating member 32 rotates along with the surface of the toner feeding roller 30, and smoothly passes through the gap between the thickness regulating member 32 and the toner feeding roller 30. This allows the toner on the thickness regulating member 32 to smoothly drop off the thickness regulating member 32.

Further, as described above, the thickness regulating member 32 rotates at a low speed (for example, at a speed lower than the speed at which the toner feeding roller 30 rotates during the developing operation). This makes it possible to reduce refloating of the toner accumulated on the thickness regulating member 32 when the thickness regulating member 32 rotates. This makes it possible to prevent the toner from adhering to the toner feeding roller 30 or the developing roller 31 to a thickness larger than the set value, or to reduce leakage of the toner to outside the developing container 20.

Further, as described above, the thickness regulating member 32 may rotate each time printing is completed with respect to a predetermined number of sheets. In this case, it is possible to efficiently drop the toner on the thickness regulating member 32 while rotating the thickness regulating member 32 minimum necessary times.

The embodiments disclosed herein are to be considered in all respects as illustrative and not restrictive. The scope of the present disclosure is set out in the appended claims and not in the description of the embodiments hereinabove, and includes any variations and modifications within the sense and scope equivalent to those of the claims.

For example, although each of the above-described embodiments exemplifies a case where the present disclosure is applied to a tandem color image forming apparatus as shown in FIG. 1, this is not meant to limit the present disclosure. As a matter of course, the present disclosure is applicable to various image forming apparatuses such as a monochrome copying machine, a monochrome printer, a digital multifunction peripheral, a facsimile, etc. having a developing device including a developing roller and a toner feeding roller.

Further, although the above-described embodiments each exemplify a case where the thickness regulating member is rotated while the developing operation is not performed, this is not meant to limit the present disclosure, and the thickness regulating member may be rotated during the developing operation.

Further, although the above-described embodiments each exemplify a case where the thickness regulating member rotates, for example, at a speed lower than the rotation speed of the toner feeding roller during the developing operation, this is not meant to limit the present disclosure, and the thickness regulating member may rotate at a speed higher than the rotation speed of the toner feeding roller during the developing operation.

Figure 4:
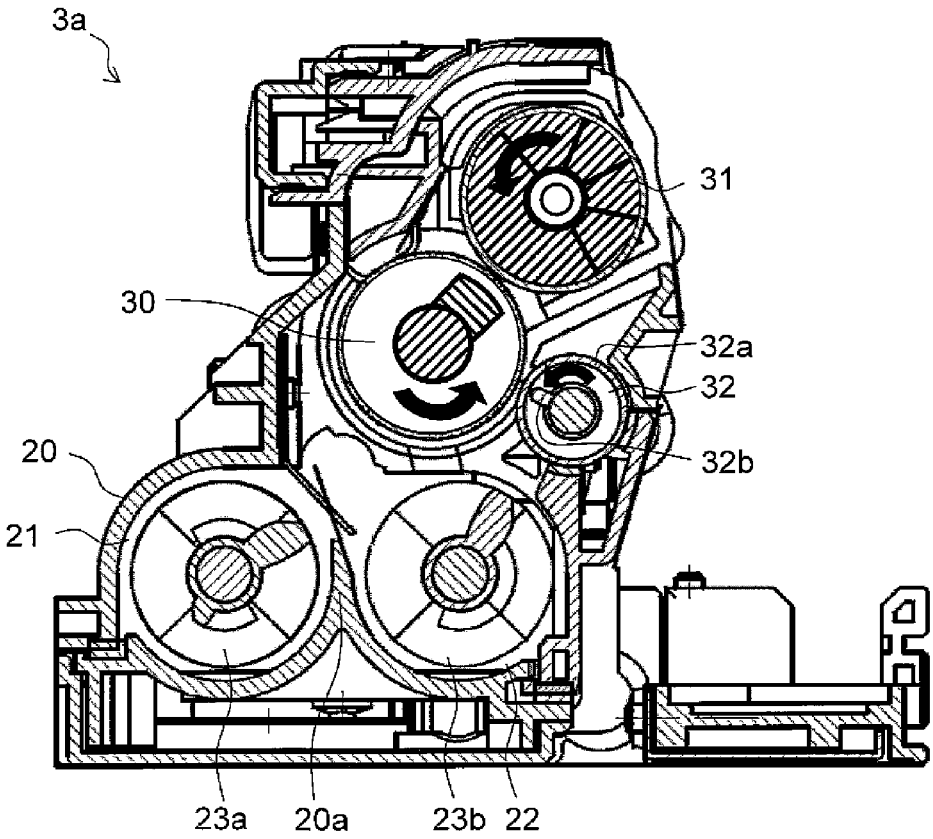
FIG. 4 is a side sectional view showing a structure of a developing device according to a modified example of the present disclosure.

Further, in the above-described embodiments, the present disclosure is applied to the developing devices 3*a* to 3*d* that each use a two-component developer to form a magnetic brush on the toner feeding roller 30, allowing only the toner to move from the toner feeding roller 30 to the developing roller 31, feeding the toner from the developing roller 31 to the photosensitive drums 1*a* to 1*d*, but this is not meant to limit the present disclosure. For example, the present disclosure is applicable to such a developing device as shown in FIG. 4, having the following structure; a developing roller 31 and a toner feeding roller 30 are disposed opposite to the above-described embodiments, toner is fed to each of photosensitive drums 1*a* to 1*d* by means of a magnetic brush of a two-component developer held on the surface of the developing roller 31 (which, in this structure, is a magnetic roller having the same structure as the toner feeding roller 30 of the above-described embodiments), the toner held on the surface of the toner feeding roller 30 (which, in this structure, has the same structure as the developing roller 31 of the above-described embodiments) is fed to the developing roller 31, and residual toner remaining on the surface of the developing roller 31 is collected by means of the toner feeding roller 30. With this structure as well, it is possible to effectively reduce accumulation and aggregation of the toner on the thickness regulating member 32.

What is claimed is:

1. A developing device comprising:

a developing roller disposed opposite to an image carrying member on which an electrostatic latent image is formed, the developing roller being configured to feed toner to the image carrying member in an opposing region where the developing roller and the image carrying member face each other;

a toner feeding roller disposed opposite to the developing roller, the toner feeding roller being configured to feed toner to the developing roller in an opposing region where the toner feeding roller and the developing roller face each other;

a thickness regulating member disposed opposite to the toner feeding roller at a predetermined distance from the toner feeding roller, the thickness regulating member being configured to regulate a thickness of toner carried on the toner feeding roller; and a casing that holds therein the developing roller, the toner feeding roller, and the thickness regulating member, wherein the thickness regulating member is disposed below the opposing region where the developing roller and the toner feeding roller face each other, the thickness regulating member is formed in a roller shape, a direction in which the thickness regulating member is rotatable and a direction in which the toner feeding roller rotates during a developing operation are opposite to each other in an opposing region where the toner feeding roller and the thickness regulating member face each other, the thickness regulating member rotates while the developing operation is not performed, and when the thickness regulating member rotates while the developing operation is not performed, the toner feeding roller rotates, in the opposing region where the toner feeding roller and the thickness regulating member face each other, in a same direction as a direction in which the thickness regulating member rotates.

2. The developing device according to claim 1, wherein the thickness regulating member includes a rotatable hollow cylindrical portion and a magnetic member that is disposed inside the cylindrical portion so as to be opposite to the toner feeding roller.

3. The developing device according to claim 1, wherein the thickness regulating member rotates at a speed that is lower than a speed at which the toner feeding roller rotates during the developing operation.

4. An image forming apparatus comprising the developing device according to claim 1.

5. The image forming apparatus according to claim 4, wherein the thickness regulating member rotates each time printing is completed with respect to a predetermined number of sheets.

* * * * *